United States Patent [19]

Dorer

[11] 4,123,267

[45] Oct. 31, 1978

[54] PHOTOCONDUCTIVE ELEMENT HAVING A BARRIER LAYER OF ALUMINUM HYDROXYOXIDE

[75] Inventor: Gary L. Dorer, Taunton, Mass.

[73] Assignee: Minnesota Mining and Manufacturing Company, St. Paul, Minn.

[21] Appl. No.: 810,577

[22] Filed: Jun. 27, 1977

[51] Int. Cl.[2] ..... G03G 5/04

[52] U.S. Cl. ..... 96/1 PC; 96/1.5 R; 427/76; 96/86 R

[58] Field of Search ..... 96/1.5, 86 R; 21/56, 21/57; 428/469, 472; 427/76; 148/6.3, 6.27; 51/309

[56] References Cited

U.S. PATENT DOCUMENTS

| | | | |
|---|---|---|---|
| 2,901,348 | 8/1959 | Dessauer et al. | 96/1 |
| 3,664,888 | 5/1972 | Oga et al. | 148/6.27 |
| 3,871,881 | 3/1975 | Mikelsons | 96/1.5 |

*Primary Examiner*—John D. Welsh

*Attorney, Agent, or Firm*—Cruzan Alexander; Donald M. Sell; James V. Lilly

[57] ABSTRACT

A photoconductive element consisting essentially of an electrically conductive substrate, a barrier layer of aluminum hydroxyoxide crystallites on said substrate and a continuous photoconductive layer over said barrier layer.

7 Claims, 2 Drawing Figures

PHOTOCONDUCTIVE ELEMENT HAVING A BARRIER LAYER OF ALUMINUM HYDROXYOXIDE

BACKGROUND OF THE INVENTION

1. Field of the Invention

This invention relates to photoconductive elements. More particularly it relates to photoconductive elements which employ a novel barrier layer of aluminum hydroxyoxide crystallites. Such elements are useful in electrophotographic copying processes.

2. Description of the Prior Art

The use of electorphotographic copying has gained widespread acceptance. In this type of reproduction a photoconductive element is first given a uniform electorstatic charge in order to sensitize its photoconductive surface. The element is then imagewise exposed to activating electromagnetic radiation thereby selectivley dissipating the charge in the illuminated areas of the photoconductive element while leaving behind a latent electrostatic image in the non-illuminted areas. This latent electorstatic image may be developed and made visible by, for example, depositing developing material (e.g., finely divided marking particles such as toner particles) on the charged surface of the photoconductive element. If the photoconductive element is of the reusable type, the toner image is then transferred to a second surface (e.g., a sheet of paper) and fixed in place thereon to form a permanent, visible reproduction of the original. If, on the other hand, an inexpensive non-reusable photoconductive element is employed the toner particles may be fixed in place directly on the surface of the element with the consequent eleimination from the process of a transfer step.

Frequently, reusable photoconductive elements comprise an electrically conductive substrate, a barrier layer on one surface therof and a photocaonductive layer on th barrier layer. Barrier layers are employed so as to reduce charge leakage in the absence of activating radiation. This phenomenon, known as dark discharge, brings about premature reduction in the electrostatic charge of image areas thereby reducing the image density on copies produced. It also limits the number of copies that can be produced from a single imaging.

A variety of materials have been suggested as barrier layers . Typically these layers comprise a thin dielectric material which is only a fraction of the thickness of the photoconductive material and is located between the substrate and the photoconductive layer. Such materials include, for example, thin layers or films of aluminum oxide ($Al_2O_3$) such as are described in U.S. Pat. No. 2,901,348. However, in order to form a satisfactory $Al_2O_3$ layer on an aluminum surface it is necessary that the naturally occuring dense $Al_2O_3$ layer be first removed (e.g., by contacting the surface with an acid bath) and then a uniformly thick $Al_2O_3$ layer be deposited on the cleaned surface. U.S. Pat. No. 3,940,270 discloses a duplex barrier layer of porous-type $Al_2O_3$ and barrier-type $Al_2O_3$. The two layers are formed consecutively by electrolytic oxidation. The electorlyte comprises a solution of a strong acid. Potentials of up to 500 volts are used during oxidation.

The adhesion of photoconductive materials to such barrier layers can be marginal. Thus, it is frequently necessary to "pair" a barrier with a particular photoconductive layer so as to obtain adequate adhesion of the latter to the former. Alternatively, the use of adhesion-promoting layers has been suggested.

For example, aluminum hydroxyoxide has been suggested so as to bond particulate material to aluminum substrates in U.S. Pat. Nos. 3,871,881 and 3,975,197. These patents describe the depostion of particulate material upon the substrate with the subsequent in-situ formation of aluminum hydroxyoxide crystals around the particles.

Netherlands Patent Publication No. 7,410,265 describes the use of a sealed anodically formed porous aluminum oxide coating between an aluminum substrate and a photoconductive layer of selenium in order to enhance the adhesion of the photoconductor to the substrate. In the process the substrate is first preferably cleaned. The naturally occurring non-porous $Al_2O_3$ layer is then removed. The substrate is then electrically anodized to form a uniform layer of porous $Al_2O_3$. This layer is then contacted with conditions and chemicals which hydrate $Al_2O_3$ sufficiently to seal the pores thereof.

While these types of constructions have met with some success, they have not proven entirely satisfactory. For example the techniques of preparing such constructions have several disadvantages attendant therewith. Certain of these procedures require the use of highly acidic materials in order to remove the $Al_2O_3$. Others require special baths and techniques in order to anodize the aluminum surface. In addtion to being time consuming and expensive, such processes also give rise to water pollution problems.

These and other disadvantages of the prior art have been overcome by the present invention by the use of a barrier layer of aluminum hydroxyoxide crystallites in photoconductive elements. Elements of the present invention eliminate the need to employ layers of particulate photoconductive material or special techniques to remove the naturally occurring aluminum oxide layer. Moreover, elements of the invention require neither the depostion of special aluminum oxide layers, nor the anodization of their aluminum surface.

The elements of the invention exhibit excellent dark decay characteristics, excellent charge uniformity and good resistance to charge decay. Futhermore, the barrier layers of elements of the invention have outstanding adhesion to both the substrate and the overlying photoconductive layer. Moreover, the preparation of the barrier layers is accomplished by a quick and simple process which is inexpensive and pollution free.

SUMMARY OF THE INVENTION

In accordance with the present invention there is provided a photoconductive element consisting essentially of (a) an electrically conductive substrate, (b) a layer of aluminum hydroxyoxide crystallites on said substrate, and (c) a continuous photoconductive layer over said layer of crystallites wherein said photoconductive layer is selected from selenium, selenium compounds and alloys of selenium.

The present invention also provides processes for preparing and utilizing these novel photoconductive elements.

BRIEF DESCRIPTION OF THE DRAWINGS

The invention will be described in more detail hereinafter with reference to the accompanying drawings wherein like reference characters refer to the same parts throughout the several views and in which.

DETAILED DESCRIPTION OF THE INVENTION

Figure 1:
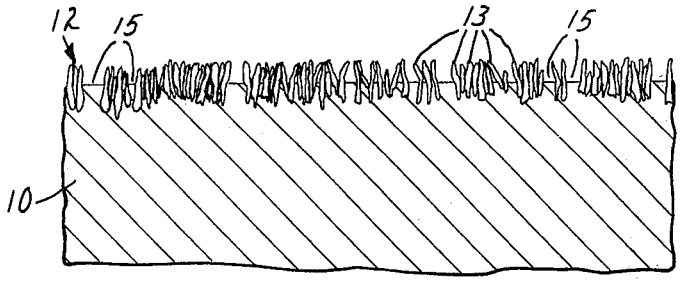
FIG. 1 is a cross-sectional view of an electrically conductive substrate having a barrier layer of aluminum hydroxyoxide crystallites thereon.

FIG. 1 shows an electrically conductive substrate 10 to which a structured barrier layer 12 of aluminum hydroxyoxide crystallites (sometimes referred to hereinafter as boehmite) is bonded. Substrate 10 preferably has an electrical resistance several orders of magnitude less than the electrical resistivity of the photoconductive layer 12 (See FIG. 2) after said layer has been illuminated. Generally substrate 10 has a specific resistivity less than $10^{10}$ ohm-cm and usually less than $10^5$ ohm-cm.

Materials which are usefu as substrate 10 include pure aluminum sheets as well as other sluminum sheet products containing up to about 30 percent or more of alloying metals. Thus elements of the invention utilize only a layer of aluminum hydroxyoxide crystallites as the barrier layer. They do not utilize specially prepared $Al_2O_3$ layers, etc. For example, useful aluminum alloys include "Lynite", a commercially available alloy of aluminum containing 5 percent by weight of copper; "Aluminum-silicon 43", a commercially available aluminum alloy containing about 5 percent silicon; "Aluminum Alloy 35", a commercially available aluminum alloy containing 1.25 percent manganese; "Aluminum Alloy 3003", a commercially available alloy containing about 98 percent aluminum, "Alumnum Alloy 1100", a commercially available alloy containing about 99.2 percent aluminum; and "aluminum Alloy 1145", a commercially available alloy containing about 99.55 percent aluminum.

Moreover, substrate 10 may comprise any substrate which has been overcoated or clad with pure aluminum or an alloy of aluminum. For exmple, metals (e.g., brass, steel, etc.) and plastic films (e.g., polyester, polycarbonate, etc.) which have coatings (e.g., thin vapor coatings) of aluminum or aluminum alloy thereon are useful. In essence substrate 10 may be any material having sufficient surface-occurring aluminum to support the growth of layer 12 (described more fully hereinafter) and which remains electrically conductive subsequent to said growth.

The structured layer 12 is formed by exposing the aluminum surface of substrate 10 to an oxidizing evironment containing water so that crystallites 13 of hydrated aluminum oxide grow in situ thereon. Although this can be done by simply immersing substrate 10 in water for a period of time, it is more preferably to expose it to a gaseus oxidizing environment that is essentially saturated with water vapor at about 20° to 150° C. For example, the aluminum surface may be introduced into an environment of steam. The water and the oxidizing atmosphere cause the in-situ growth of a structured layer on the aluminum surface of substrate 10. This layer forms an irregular face (e.g., one having a number of peaks and valleys). The individual crystallites 13 are randomly positioned with respect to each other and have varying heights and shapes. Preferaby the bases of crystallites 13 are in contact with the bases of adjacent crystallites. However, there may be small areas 15 of substrate 10 where no crystallites are formed.

Because of the irregualar nature of crystallites 13 which make up layer 12, the thickness of layer 12 varies. However it has been found that the thickness of the layer is not critical to the invention. Thus it may have a thickness of up to about 200 nanometers or more.

The exposure time required to prepare layer 12 depends primarily upon the temperature of the oxidizing environment and the thickness of layer 12 desired. Thus increasing the thickness of layer 12 requires a corresponding increase in the length of the exposure time. The requisite exposure time may be shortened by increasing the temperature of the oxidizing environment.

The oxidizing environment to which the aluminum surface is exposed may be a water bath, although preferably it is an atmosphere obtained by admitting steam into an open vessel. Closed vessels containing steam and air at pressures ranging from atmospheric to pressures of 100 psi or more may also be used. By regulation of the quantity and pressure of steam introduced into the vessel, temperatures from about 50° to about 150° C. suitable for causing the formation of aluminum hydroxyoxide crystallites may be obtained. The ratio of steam to air is not critical, a suitable range being between about 1:20 to 20:1 parts of air per part of steam.

Oxidizing gases (for example, oxygen) may be used to replace part or all of the air used in the oxidative atmospheres.

Preferably, the aluminum surface of substrate 10 is cleaned of oil and surface impurities by any of the conventional processes heretofore used for cleaning aluminum. The cleaned surface is then perferably rinsed with deionized water prior to exposure to the oxidizing environment. Although it is not necessary to remove the naturally occurring dense aluminum oxide film from the surface of the substrate, this may be done if desired. Usually, however, the aluminum substrate is simply cleaned by washing it with an aqueous solution of a conventional surfactant or detergent, followed by rinsing with water and, optionally, drying. Organic solvents may be used to remove oils from the aluminum surfaces.

Figure 2:
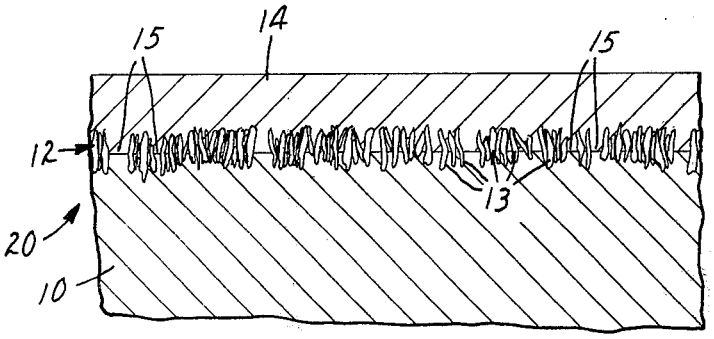
FIG. 2 is a cross-sectional view of the construction of FIG. 1 with a continuous photoconductive layer over the barrier layer.

Referring now specifically to FIG. 2 there is shown a photoconductive element 20 consisting essentially of an electrically conductive substrate 10, a layer 12 of aluminum hydroxyoxide crystallites 13 on said substrate and a continuous photoconductive layer 14 over layer 12.

The photoconductive materials employed as layer 14 are selected from selenium, selenium compounds and alloys of selenium. When selenium is used it may be in the amorphous or vitreous form. Representative useful compounds of selenium include arsenic selenide ($As_2Se_3$), cadmium selenide, tellurium selenide, etc. Representative useful selium alloys include alloys of selenium with arsenic or tellurium in the vitreous form, arsenic tellurium doped selenium, etc. Preferably the photoconductive material is selected from vitreous selenium, arsenic or tellurium alloys and arsenic selenide.

The photoconductive material is applied to the aluminum hydroxyoxide layer so as to provide a continuous surface thereon. The thickness of the photoconductive layer is not critical to the present invention. However, it should be of sufficient thickness so as to provide a visible image when the photoconductive element is processed by electrophotographic techniques. Thus, the photoconductive layer is preferably in the range of about 40 to 60 microns thick.

The photoconductive layer may be applied to the aluminum hydroxyoxide layer by a variety of techniques. Typically it is applied by evaporating it onto the aluminum hydroxyoxide layer by techniques known to the art.

The present invention is further illustrated by means of the following examples wherein the term "parts", refers to parts by weight unless otherwise indicated.

EXAMPLE 1

A photoconductive element was prepared by treating a 200 micron thick aluminum plate with saturated steam at a temperature of approximately 95° C. for 90 seconds. During this time a barrier layer of aluminum hydroxyoxide crystallites was formed on the plate. A 5 micron thick photoconductive layer comprising pure selenium was then vapor-coated onto the barrier layer.

The good adhesion of the photoconductive layer to the barrier layer was demonstrated by applying a section of SCOTCH ® "Magic Mending Tape" (commercially available from Minnesota Mining and Manufacturing Company) to the selenium layer. The tape was applied with normal finger pressure and then rapidly stripped from the layer. The adhesive of the tape remained upon the selenium layer when the tape was stripped therefrom. When this test is repeated on photoconductive elements which employ naturally occurring aluminum oxide ($Al_2O_3$) as the barrier layer, the photoconductive layer is removed by the tape.

EXAMPLE 2

A 50 micron thick sheet of biaxially oriented poly(ethyleneterephthalate) was vapor coated with a 0.3 micron thick layer of aluminum on one side. The entire aluminumized film was treated with saturated steam as described in Example 1 to produce a barrier layer of aluminum hydroxyoxide. A 1 micron thick layer of photoconductive material (arsenic selenide) was then vapor-coated onto the barrier layer.

The good adhesion of the arsenic selenide layer to the barrier layer was exhibited as described in Example 1. The adhesive of the tape was removed from the tape backing when the tape was stripped from the photoconductive layer.

EXAMPLE 3

A series of photoconductive elements was prepared using several aluminum drums. The drums were washed with a detergent soap and then rinsed with deionized water. One-half of each drum was then contacted with saturated steam at 98° C. for 10 minutes to produce a barrier layer of aluminum hydroxyoxide crystals (Boehmite). The other half of each drum was protected from contact by the steam so that the naturally occurring $Al_2O_3$ layer thereon remained substantially unchanged. A photoconductive layer comprising an alloy of selenium (99.5 percent by weight selenium and 0.5 percent by weight arsenic) was then vapor-coated over both halves of each drum. The resulting drums consisted of an electrically conductive substrate, a barrier layer of aluminum hydroxyoxide crystallites on said substrate and a continuous photoconductive layer.

The photoconductive elements were then electrostatically charged and tested for their voltage acceptance, one second dark decay characteristics and 50 second dark decay characteristics. The results of these tests are reported in Table 1.

TABLE 1

| DRUM | BARRIER LAYER | THICKNESS PHOTOCONDUCTIVE LAYER (MICRONS) | INITIAL VOLTAGE ACCEPTANCE (VOLTS) | DARK DECAY (VOLTS) 1 SEC | 50 SEC |
|---|---|---|---|---|---|
| A | Boehmite | 48 | 890 | 30 | 250 |
| | $Al_2O_3$ | 48 | 880 | 70 | 460 |
| B | Boehmite | 50 | 930 | 20 | 150 |
| | $Al_2O_3$ | 48 | 800 | 150 | 650 |
| C | Boehmite | 52 | 930 | 15 | 150 |
| | $Al_2O_3$ | 50 | 800 | 120 | 650 |

As can be seen those portions of the drums employing boehmite barrier layers exhibited better initial voltage acceptance than did those portions of the drums employing naturally occurring $Al_2O_3$ barrier layers. Additionally the former portions of the drums had dramatically better dark decay characteristics than did the latter.

Because of these properties copies produced from elements employing boehmite barrier layers have denser images and less background than do copies produced from elements employing $Al_2O_3$ barrier layers. Additionally the improved dark decay characteristics of elements of the invention enable a greater number of copies to be produced from a single charging and imaging.

What is claimed is:

1. A photoconductive element consisting essentially of (a) an electrically conductive substrate, (b) a layer of aluminum hydroxyoxide crystallites on said substrate, and (c) a continuous photoconductive layer over said layer of crystallites wherein said photoconductive layer is selected from selenium, selenium compounds and alloys of selenium.

2. A photoconductive element in accordance with claim 1 wherein said photoconductive layer is selenium.

3. A photoconductive element in accordance with claim 1 wherein said photoconductive layer is an alloy of selenium.

4. A photoconductive element in accordance with claim 3 wherein said alloy comprises at least about 99.5% by weight selenium, the remainder comprising arsenic or tellurium.

5. A photoconductive element in accordance with claim 4 wherein said alloy comprises at least about 99.5% by weight selenium and the remainder is arsenic.

6. A photoconductive element in accordance with claim 1 wherein said photoconductive element is a compound of selenium.

7. A photoconductive element in accordance with claim 6 wherein said compound is $As_2Se_3$.

* * * * *

UNITED STATES PATENT AND TRADEMARK OFFICE

CERTIFICATE OF CORRECTION

PATENT NO. : 4,123,267

DATED : October 31, 1978

INVENTOR(S) : GARY L. DORER

It is certified that error appears in the above-identified patent and that said Letters Patent are hereby corrected as shown below:

In the Specification:

Page 2, line 10 (Col. 1, line 39), "photocaonductive" should read --photoconductive--.

Page 5, line 26 (Col. 3, line 21), "sluminum" should read --aluminum--.

Page 6, line 27 (Col. 3, line 35), "preferably" should read --preferable--.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*